US008059113B2

(12) United States Patent
Lai et al.

(10) Patent No.: US 8,059,113 B2
(45) Date of Patent: Nov. 15, 2011

(54) DISPLAY HAVING ILLUMINATION FUNCTION

(75) Inventors: Hsiu-Chang Lai, Taipei Hsien (TW); Ming-Ke Chen, Shenzhen (CN); Ke Sun, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 969 days.

(21) Appl. No.: 11/965,759

(22) Filed: Dec. 28, 2007

(65) Prior Publication Data

US 2009/0160837 A1 Jun. 25, 2009

(30) Foreign Application Priority Data

Dec. 19, 2007 (CN) ..... 2007 1 0203213

(51) Int. Cl.
*G09G 5/00* (2006.01)

(52) U.S. Cl. ..... 345/211

(58) Field of Classification Search ..... 345/102, 345/211–213, 204
See application file for complete search history.

(56) References Cited

U.S. PATENT DOCUMENTS

| | | | | |
|---|---|---|---|---|
| 5,430,493 | A * | 7/1995 | Kim | 348/564 |
| 5,703,662 | A * | 12/1997 | Yoon | 348/728 |
| 6,590,597 | B1 * | 7/2003 | Kim | 715/866 |
| 6,731,958 | B1 * | 5/2004 | Shirai | 455/574 |
| 2004/0129776 | A1 * | 7/2004 | Choi | 235/380 |
| 2005/0009126 | A1 * | 1/2005 | Andrews et al. | 435/14 |
| 2006/0132437 | A1 * | 6/2006 | Kim | 345/157 |
| 2006/0145645 | A1 * | 7/2006 | Kim et al. | 318/483 |

* cited by examiner

*Primary Examiner* — Amr Awad
*Assistant Examiner* — Stephen Bray
(74) *Attorney, Agent, or Firm* — Altis Law Group, Inc.

(57) ABSTRACT

A display includes a display circuit, a power module connected to the display circuit to supply power thereto, a display card chip, and a switch. The power module is connected to a power pin of the display card chip via the switch. A driving pin of the display card chip is connected to the display circuit and is able to control the display to display a white screen.

2 Claims, 2 Drawing Sheets

DISPLAY HAVING ILLUMINATION FUNCTION

BACKGROUND

1. Field of the Invention

The present invention relates to displays, and particularly to a display which has an illumination function.

2. Description of Related Art

Referring to FIG. 1, a block diagram of a conventional display 100 connected to a computer 200 is illustrated. The display 100 includes a display circuit 120 and a power module 140 configured to supply power to the display circuit 120. When the computer 200 transmits video signals to the display circuit 120, the display 100 will display corresponding video images thereon. However, when the computer 100 isn't operating, the display 100 has no usefulness and the screen is dark.

What is desired, therefore, is to provide a display which has an illumination function.

SUMMARY

An embodiment of a display includes a display circuit, a power module connected to the display circuit to supply power thereto, a display card chip, and a switch. The power module is connected to a power pin of the display card chip via the switch. A driving pin of the display card chip is connected to the display circuit so the display can have a white screen.

Other advantages and novel features of the present invention will become more apparent from the following detailed description of an embodiment when taken in conjunction with the accompanying drawings, in which:

DETAILED DESCRIPTION

Figure 1:
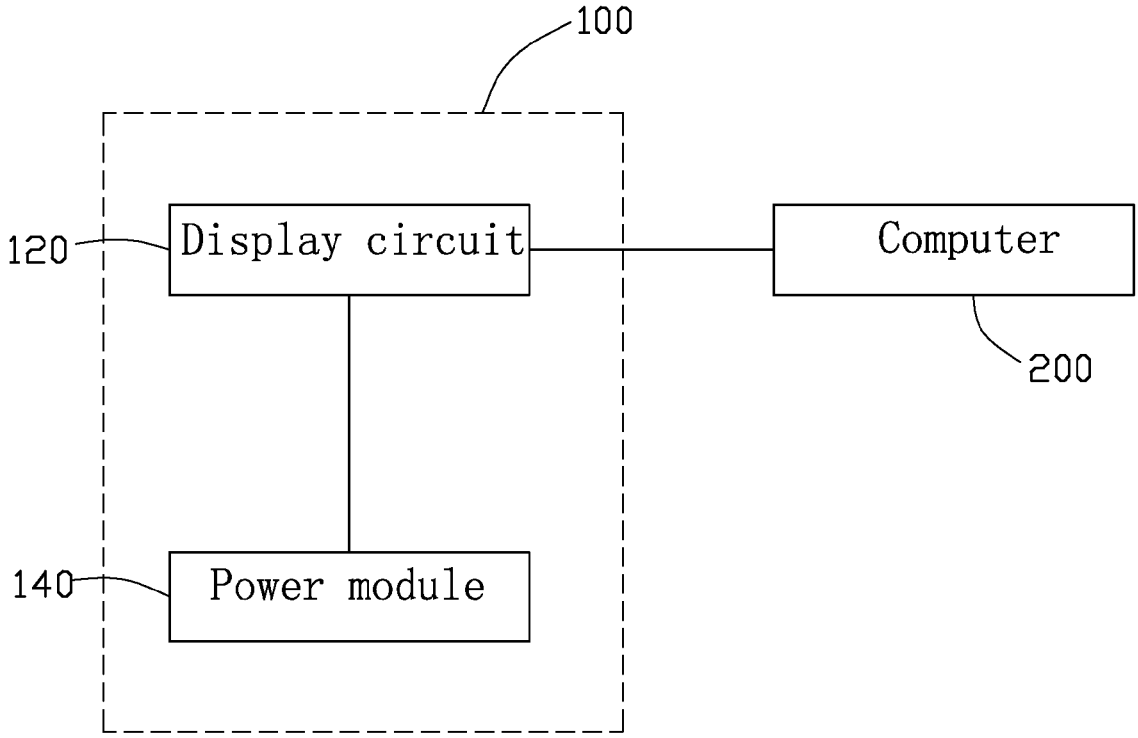
FIG. 1 (RELATED ART)
FIG. 1 is a block diagram of a conventional display, together with a computer.
Figure 2:
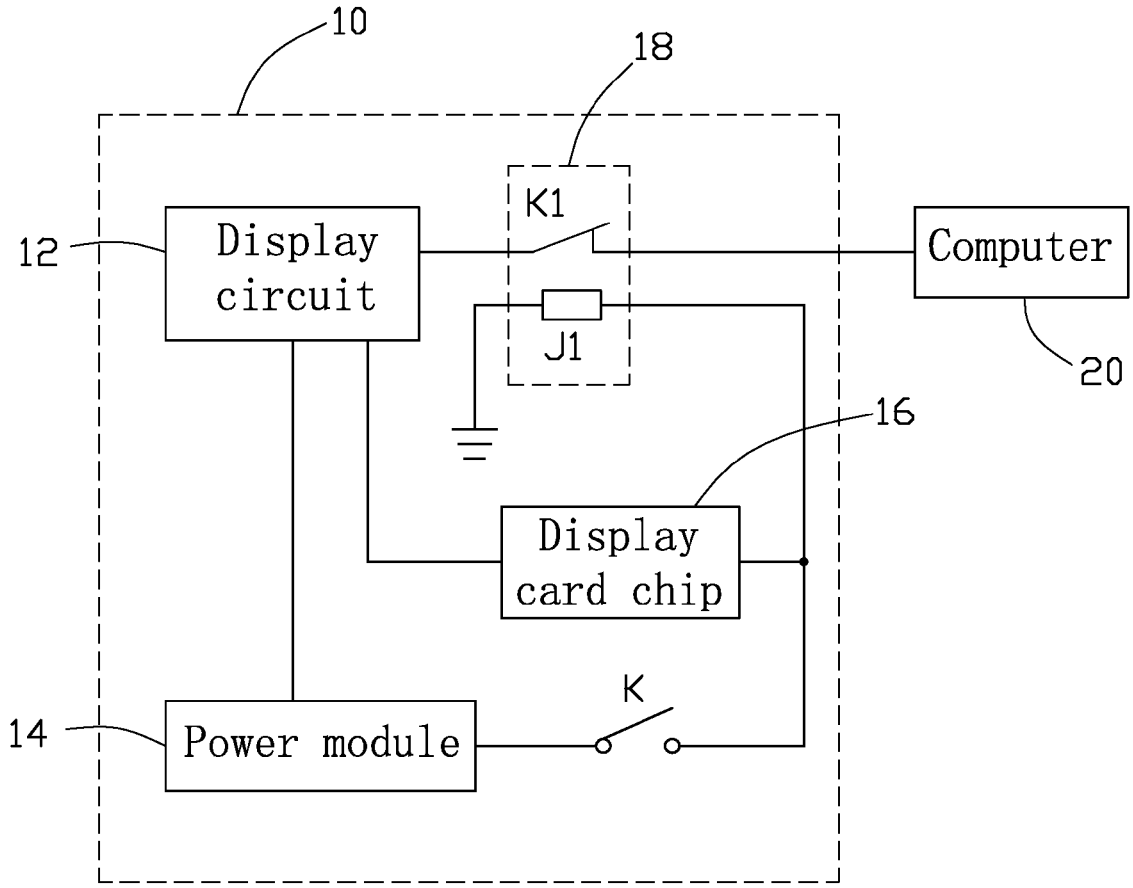
FIG. 2 is a block diagram of a display in accordance with an embodiment of the present invention, together with a computer.

Referring to FIG. 2, a display 10 in accordance with an embodiment of the present invention includes a display circuit 12, a power module 14, a display card chip 16, a relay 18 having a coil J1 and a normally closed switch K1, and switch K.

The power module 14 is connected to the display circuit 12 to supply power to the display circuit 12. The power module 14 is connected to a power pin of the display card chip 16 via the switch K to supply power to the display card chip 16. A driving pin of the display card chip 16 is connected to the display circuit 12 to selectively control the display 10 to have a white screen. The power module 14 is connected to ground via the coil J1 of the switch K. The display circuit 12 is connected to a terminal of the normally closed switch K1. The other terminal of the normally closed switch K1 is configured to connect to a computer 20.

When the computer 20 is connected to the display circuit 12 via the normally closed switch K1, the computer 20 works and the switch K is turned off. The display 10 will display corresponding video images thereon. If the switch K is turned on, the coil J1 of the relay 18 operates the normally closed switch K1 to be turned off, so that the computer 20 cannot transmit video signals to the display circuit 12. At the same time, the display card chip 16 works and drives the display 10 to have a white screen, thereby the display 10 provides illumination and can function as a lamp.

In other embodiments, the relay 18 can be deleted to save cost. If user needs the display 10 to be used as a lamp, the user can cut off the computer 20 and turn on the switch K, and then the display 10 has the illumination function, which is very convenient.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A display comprising:

a display circuit;

a power module connected to the display circuit to supply power thereto;

a display card chip;

a switch; and a relay comprising a coil and a normally closed switch, wherein the power module is connected to a power pin of the display card chip and a first terminal of the coil of the relay via the switch, a second terminal of the coil of the relay is grounded, a first terminal of the normally closed switch is connected to the display circuit, a second terminal of the normally closed switch is connected to a video device, a driving pin of the display card chip is connected to the display circuit, when the switch is turned on, the power module powers the relay to disconnect the display circuit from the video device, and powers the display card to drive the display to display a white screen to provide illumination.

2. The display as claimed in claim 1, wherein the video device is a computer.

* * * * *